United States Patent [19]

Fitzwater, deceased

[11] 4,152,193

[45] * May 1, 1979

[54] HEAT TRANSFER PRESS

[75] Inventor: John H. Fitzwater, deceased, late of Warwick, R.I., by Amelia Fitzwater, executrix

[73] Assignee: Fitzwater Engineering Company, Warwick, R.I.

[ * ] Notice: The portion of the term of this patent subsequent to Jun. 21, 1994, has been disclaimed.

[21] Appl. No.: 746,996

[22] Filed: Dec. 2, 1976

Related U.S. Application Data

[63] Continuation-in-part of Ser. No. 661,743, Feb. 26, 1976, Pat. No. 4,030,962.

[51] Int. Cl.[2] ..... B44C 1/16; B30B 5/02; B30B 15/34

[52] U.S. Cl. ..... 156/366; 68/5 C; 100/93 P; 101/470; 156/384

[58] Field of Search ..... 156/583; 8/2.5 A; 68/5 C; 101/470; 100/93 P

[56] References Cited

U.S. PATENT DOCUMENTS

| | | | |
|---|---|---|---|
| 3,012,601 | 12/1961 | Lee | 156/583 |
| 3,444,029 | 5/1969 | Renaud et al. | 156/583 |
| 3,889,586 | 6/1975 | Pretty | 100/229 R |
| 3,935,811 | 2/1976 | Lenz et al. | 100/229 R |
| 3,942,431 | 3/1976 | Goff | 100/229 R |

FOREIGN PATENT DOCUMENTS

| | | | |
|---|---|---|---|
| 2339 of | 1888 | United Kingdom | 38/28 |

OTHER PUBLICATIONS

The Needle's Eye; An Introduction to Sublimated Heat Transfer Printing, pp. 24–27, Oct./Nov. 1975.

Textile Trends; Transfer Printing of Textile Fabrics by Bhagwat, pp. 59–66, Feb. 1975.

American Dyestuff Reporter; Machinery Report, pp. 11, 42–44, 46, Oct. 1975.

Japanese Textile News; Japanese Transfer Printing Takes Action, pp. 62, 63, Feb. 1972.

*Primary Examiner*—Clyde I. Coughenour

*Attorney, Agent, or Firm*—William Frederick Werner

[57] ABSTRACT

This invention relates to heat transfer presses and more particularly to the transferring of a colored picture printed on paper to polyester knit goods by means of heat and pressure. The polyester cloth heat softens while the ink vaporizes and passes through the interstices of the cloth. The cooling of the cloth locks the vapors in the material producing the effect of a dyeing process.

3 Claims, 10 Drawing Figures

FRONT VIEW

END VIEW

HEAT TRANSFER PRESS

CROSS-REFERENCE

The present invention is a continuation-in-part of U.S. patent application Ser. No. 661,743 filed Feb. 26, 1976 for a Heat Transfer Press now U.S. Pat. No. 4,030,962 issued June 21, 1977.

STATEMENT OF INVENTION

This invention relates to heat transfer presses and more particularly to the transferring of ink in the form of a picture printed upon paper to polyester material through heat and pressure. The ink vaporizes and impregnates the heat softened fibers. Cooling permanently locks the dye in the fibers.

In the prior art, heat transfer presses transferred colored pictures to cloth by means of the fusion process. That is, the ink was transferred to the cloth by means of heat and pressure in a manner similar to attaching a picture to the cloth by means of an adhesive. The ink was not embedded into the fibers of the cloth. Consequently, repeated washings or cleaning dissolved the ink or wore the ink away from the cloth. The ink faded through garment use.

OBJECTS OF THE INVENTION

Accordingly, it is an object of the present invention to provide means whereby a picture printed in ink on paper or the like, is transferred to material so as to impregnate the fibers of the material to become permanently and irrevocably attached to the material.

Another object of the present invention is to transfer a picture from a printed sheet to material so that the picture is permanently attached to the material to withstand long wear and cleaning processes.

Other objects of the present invention will be pointed out in part and become apparent in part in the following specification and claims.

BRIEF DESCRIPTION OF THE DRAWINGS

Referring to the drawings in which similar characters of reference indicate corresponding parts in all the figures.

DESCRIPTION OF THE PREFERRRED EMBODIMENT

Figure 1:
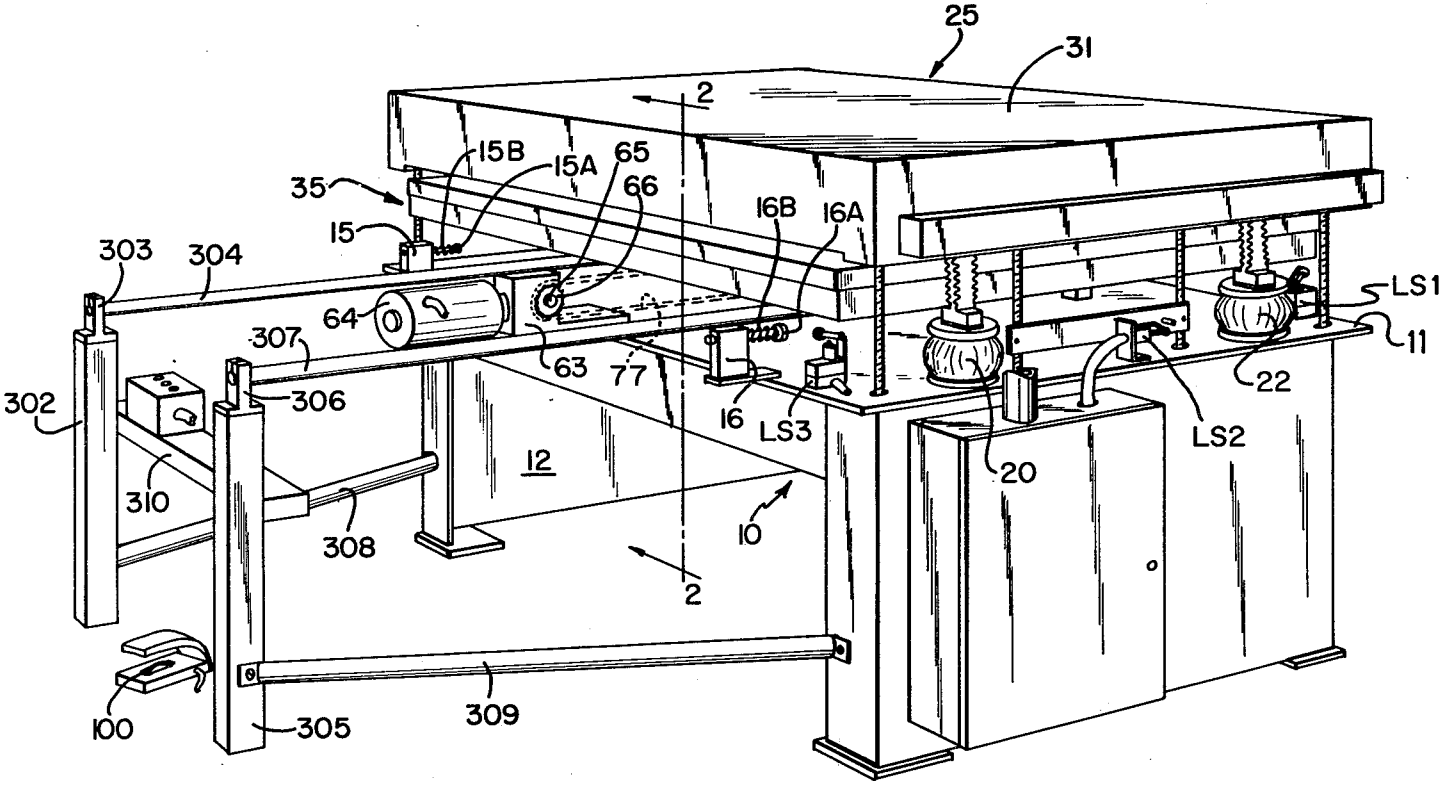
FIG. 1 is a perspective view of the new and improved heat transfer press.
Figure 4:
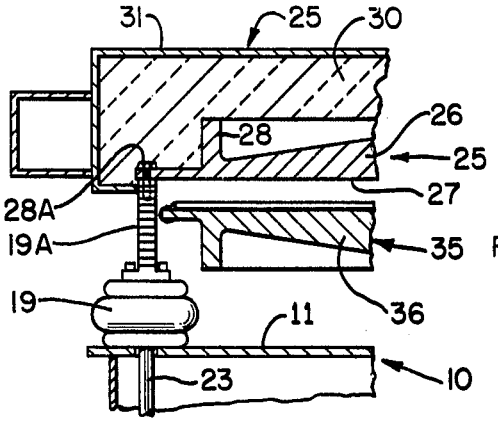
FIG. 4 is a skematic front cross-sectional view showing the table, the lower platen, the upper platen and the air lift.
Figure 2:
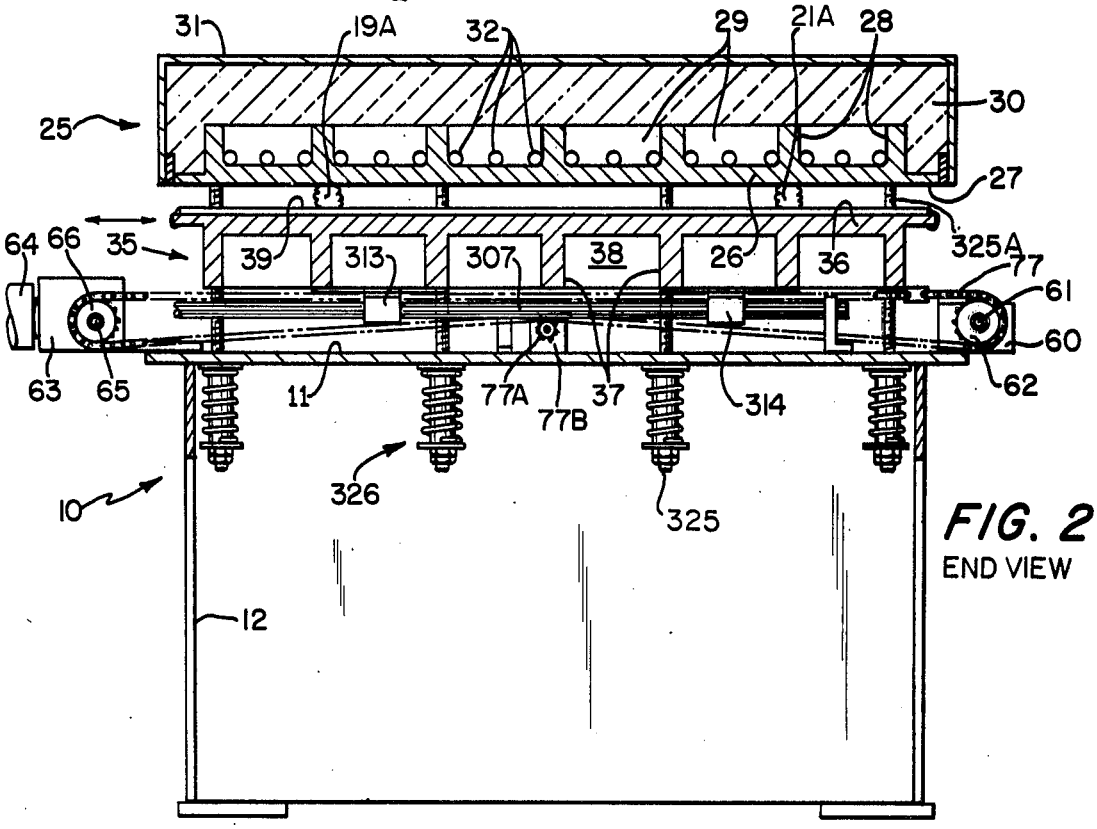
FIG. 2 is a vertical end cross-sectional view taken on line 2—2 of FIG. 1.
Figure 5:
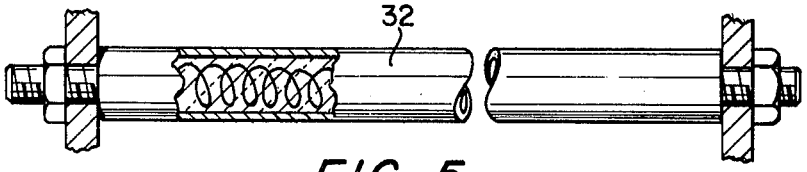
FIG. 5 is a view of a radiant heat unit with a section broken away to show the construction.
Figure 3:
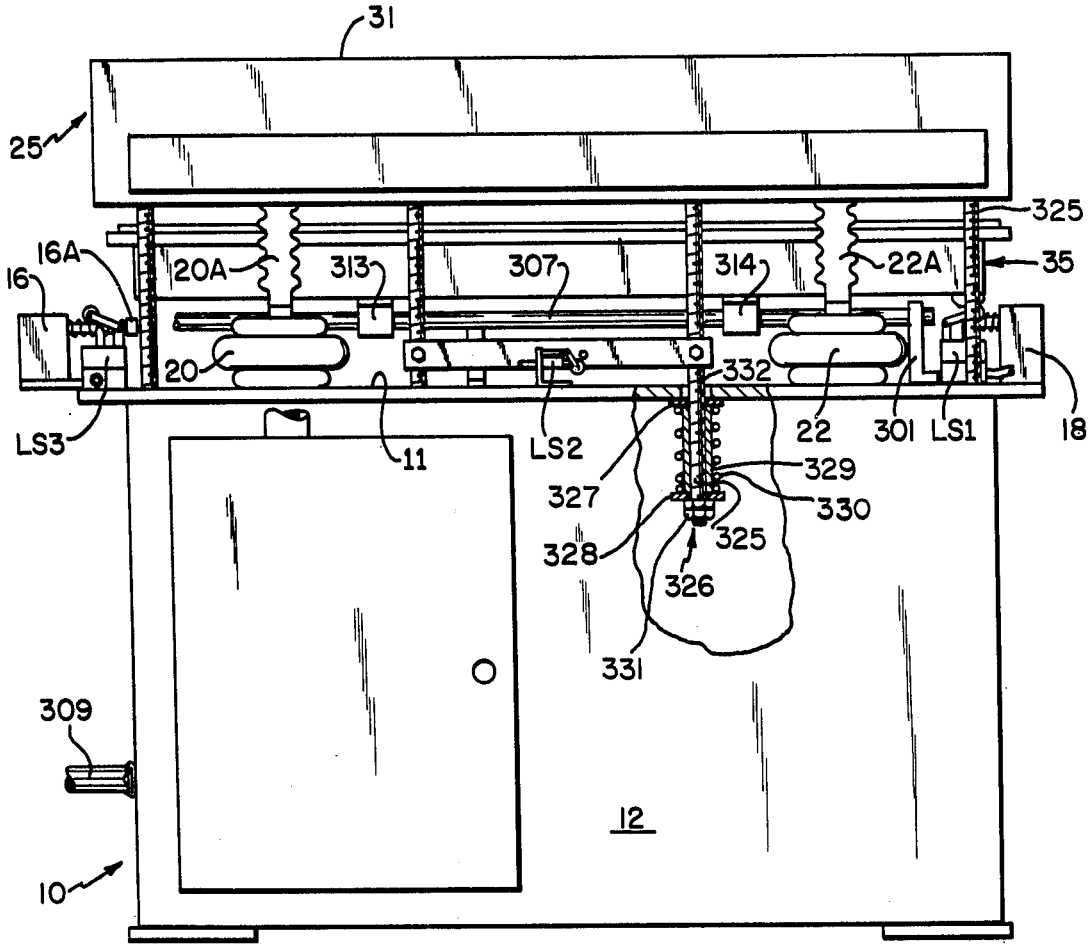
FIG. 3 is a right side elevational view of FIG. 1.
Figure 6:
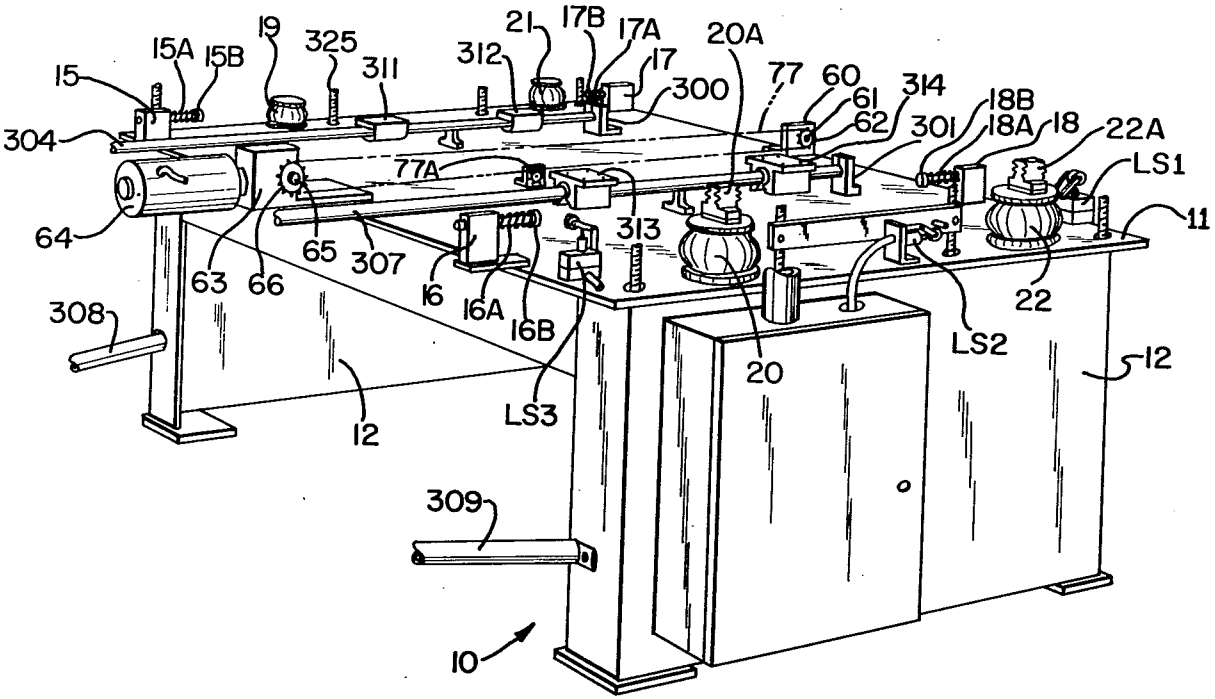
FIG. 6 is a view, similar to FIG. 1, with the top of the machine removed.

In proceeding with this invention, reference is made to the drawings, wherein is illustrated the new and improved heat transfer press. Specific reference is made to FIGS. 1, 2, 3 and 6.

A table, generally indicated by reference numeral 10 comprises a table top 11 fastened to and supported at a desired height by a frame 12. An "L" shaped bracket 60 is fastened to top 11. A stub shaft 61 is fastened in bracket 60. A sprocket 62 is rotatably mounted upon stub shaft 61. A gear box 63 is fastened to top 11. An electric motor 64 is fastened to gear box 63. A shaft 65 provided with a sprocket 66 on one end is rotably mounted in gear box 63. A bevel gear (not shown) is mounted upon the other end of shaft 65. Said bevel gear meshes with a bevel gear (not shown) on the motor shaft, thereby to rotate sprocket 66. A chain 77 connects sprockets 62, 66 for rotational movement. An idler pulley 77A is rotatably mounted in bracket 77B fastened to table top 11.

A left rod bracket 300 and a right rod bracket 301 are each fastened to top 11. A left stanchion 302 is provided with a rod support 303. A left slide rod 304 is fastened on opposite ends in left rod bracket 300 and in rod support 303. Similarly, a right stanchion 305 is provided with a rod support 306. A right slide rod 307 is fastened on opposite ends in right rod bracket 301 and in rod support 306. Supporting legs 308, 309 are fastened, respectively, on opposite ends to frame 12 and stanchions 302, 305. A shelf 310 is fastened on opposite ends to stanchions 302, 305. Two bearing left side pads 311, 312 are slidably mounted upon left slide rod 304. Similarly, two bearing right side pads 313, 314 are slidably mounted upon right slide rod 307. Said two stanchions 302 and 305 constituting an extension of said table 11.

Four stopper blocks 15, 16, 17 and 18 are fastened to table top 11, as by welding. Studs 15A, 16A, 17A, 18A each provided with a head are slidably mounted, respectively, in blocks 15, 16, 17, 18. Coil springs 15B, 16B, 17B, 18B, are slidably mounted, respectively, upon studs 15A, 16A, 17A, 18A between the, respective, blocks and heads. Four expandable resilient material air lift cylinders 19, 20, 21, 22, each provided, respectively, with a heat dissapating lug 19A, 20A, 21A, 22A, are fastened to table top 11. A pneumatic or air conduit 23 is attached to each of the four air lift cylinders 19, 20, 21, 22 so that they can act and react in unison, as will presently appear. (See FIGS. 1, 3, 4, 6, 9.)

A heated upper platen, generally indicated by reference numeral 25, consists of a body 26, having a face 27 and a plurality of ribs 28 which form a plurality of chambers 29 therebetween. (See FIGS. 2 and 4.) Each of the air lift cylinder heat dissipating lugs 19A, 20A, 21A, 22A are, respectively, fastened to body 26, as by a screw 28A. A blanket 30 of insulating material is placed over the top and sides of body 26, exposing face 27 and providing a closure for chambers 29. Preferably, a metal cover 31 surrounds the sides and top of blanket 30 and is used to fasten blanket 30 to body 26. A plurality of radiant heating tubes 32 are, selective as to quantity, fastened in chambers 29 so as to heat upper platen 25 and especially face 27.

Reference is directed to FIGS. 2, 3, 6 and 9. A plurality of rods 325 are each fastened to body 26 on one end and are provided with a compression spring resistance mechanism, generally indicated by reference numeral 326, on the other end. The compression spring mechanism consists of two collars 327, 328 of enlarged diameters separated by a sleeve 329 of a smaller diameter. A compression spring 330 surrounds sleeve 329 and is spaced between collars 327, 328. Two nuts 331 are rotatably mounted upon rod 325 to abut collar 328. Collar 327 abuts the underside of table 11 which is provided with a series of clearance holes 332 to accommodate rods 325. The compression spring mechanism 326 resiliently urges heated upper platen 25 downwardly twoards cold lower platen 35, against the resistance of the four air lift cylinders 19, 20, 21 and 22.

A cold lower platen, generally indicated by reference numeral 35, consists of a surface plate 36 provided with a plurality of projections 37 which form heat dissipating spaces 38. A silicone pad 39 is fastened to surface plate 36. Cold lower platen 35 is fastened to left bearing pads 311, 312 and to right bearing pads 313, 314. A link connector 325A is fastened to chain 77 and to cold lower platen 35 through one of the projections 37. In this manner, motor 64 pulls cold lower platen 35 into and out of register with heated upper platen 25.

Figure 9:
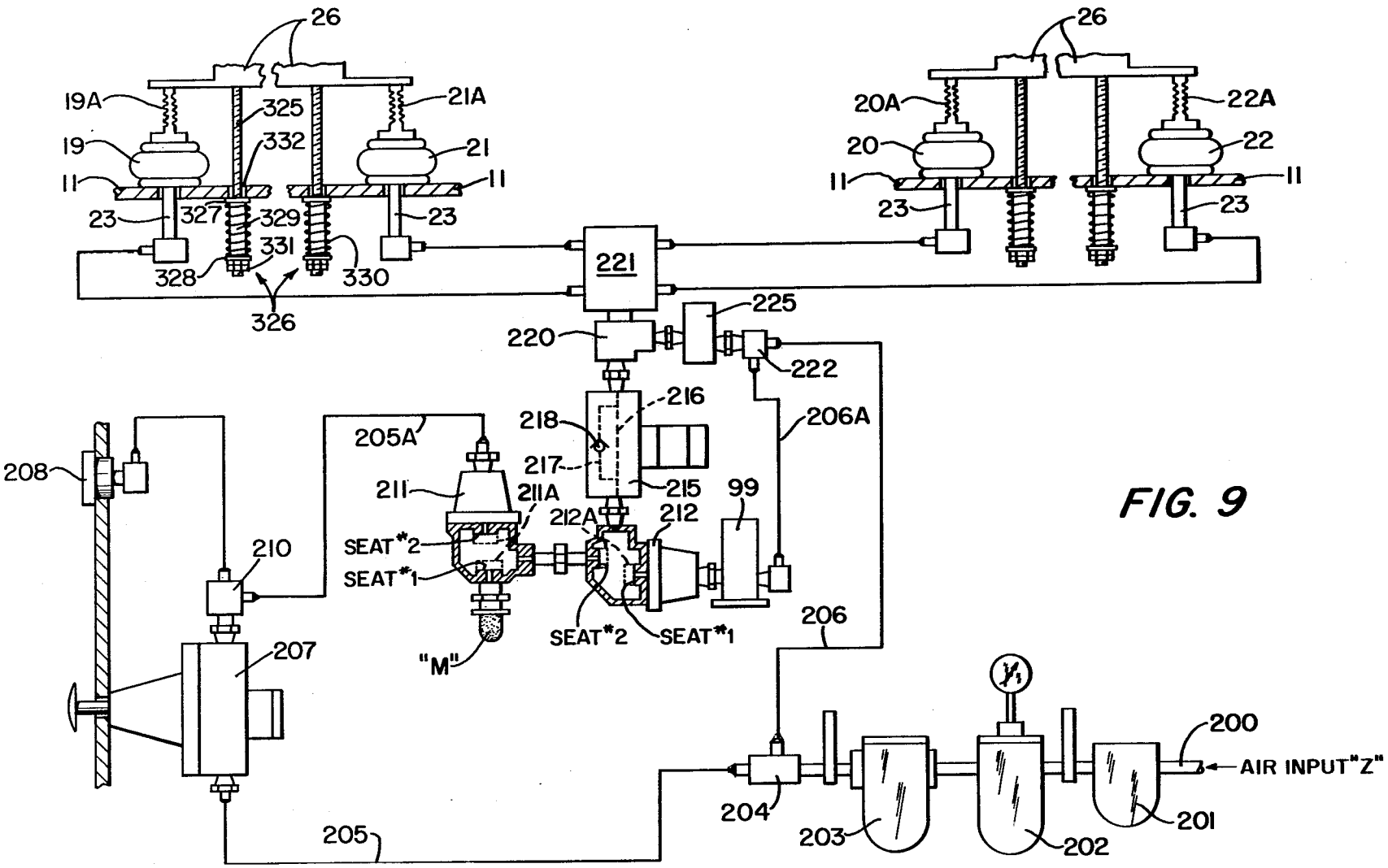
FIG. 9 is a diagramatic view of the air system.

The pneumatic system will now be described with reference to FIG. 9. A source of air supply enters conduit 200 at "Z". After passing through filter 201, regulator 202 and lubricator 203, the pressurized air enters pipe "T" 204 where the air line divides into two sections; low pressure side 205 and high pressure side 206.

High pressure conduit 206 connects pipe "T" 204 with pipe fitting 222 where the air line is again divided. First, through conduit 206A to a first solenoid valve 99 and second to solenoid valve 225 connected to mainfold 221 through pipe connection 220. First solenoid valve 99 is air connected to a first shuttle valve 212 which is air connected to adjustable flow control valve 215 which is air connected to pipe connection 220 and manifold 221 which is air connected to each of the four air lift cylinders 19, 20, 21, 22.

Conduit 205 connects pipe "T" 204 with pressure regulator 207 where the high pressure is converted to low pressure (high pressure in, low pressure out) and through pipe "T" low pressure connection 210 where the air line is divided to, first, gauge 208 and second to second shuttle valve 211 through conduit 205A. Shuttle valve 211 is air connected to shuttle valve 212.

Shuttle valves 211, 212 each are provided with a diaphragm, respectively, 211A, 212A, which can seat on one of two seats within the valve. Flow control valve 215 is provided with two passageways 216, 217. A ball 218 blocks passageway 217 in one direction. Passageway 216 is manually adjustable for air flow.

In order to describe a cycle of operation for the pneumatic controls, let it be assumed that the hot upper platen 25 is in top position and cold lower platen 35 is in outboard or loading position. Solenoid valve 225 has just closed blocking high pressure air from conduit 206. Solenoid valve 99 is open.

Pressurized air at approximately 100 p.s.i., entering conduit 206, passes to and through pipe fitting 222 in two directions to manifold 221 to lift the hot upper platen 25 via, the four air lift cylinders 19, 20, 21, 22 against the forces of the plurality of compression spring resistance mechanisms 326.

The first direction is to solenoid valve 225, now closed. The second direction is through conduit 206A to solenoid valve 99, shuttle valve 212, with the diaphragm against seat #2 to block low pressure air flow into shuttle valve 212, and through passageway 216 in flow control valve 215, to pipe connection 220 and to manifold 221.

Electrical (foot) switch 100 is manually actuated to start motor 64 rotating in a forward direction, whereby chain 77 moves cold lower platen 35 from outboard or out-of-register position to register or working position under hot upper platen 25. In moving upon slide rods 304, 307, cold lower platen 35 strikes (lever switch) LS #1, whereby solenoid valve 99 is electrically actuated to block or shut off high pressure air from conduit 206A. The low pressure air in shuttle valve 211 moves the diaphragm in shuttle valve 212 from seat #2 to seat #1 to insure block passage of shutoff high pressure air into shuttle valve 212. The high pressurized air in air lifts 19, 20, 21, 22 now begins a reverse flow against the low pressurized air, at approximately 10 p.s.i., through manifold 221, pipe connection 220 to flow control valve 215, passageway 217, unseating ball 218, through shuttle valve 212 to shuttle valve 211 where the diaphragm moves to seat #2 to allow the air to be exhausted to the atmosphere through muffler "M", until the pressure of the exhausting air from manifold 221 equals the low pressure air in conduit 205A. When that occurs, the diaphragm seated on valve #2 shifts to seat #1 to block passage of the exhausting air and now back pressure from pressure regulator 207 flows through shuttle valves 211, 212 passageway 216 through and to the manifold 221. The back pressure controls the weight force contact of the hot upper platen 25 against the work and cold lower platen 35.

During the period of time that the pressurized air is being vented to the atmosphere, the springs 326 and the weight of the upper platen 25 allow the upper platen to move downwardly in working position against lower platen 35. As upper platen 25 moves downwardly, it strikes LS #2 to energize timer 98 to start a time count cycle. When the time count cycle is completed, the heat transfer of the picture from the transfer printed paper to the cloth is accomplished. The timer 98 then starts a new cycle wherein solenoid valve 99 is de-energized whereby the high pressure line is opened to manifold 221 as previously described.

Simultaneously with the start of the new cycle and the de-energization of solenoid valve 99, timer 98 energizes time delay relay TD 2 to start a timing cycle. At a predetermined time set in time delay relay TD 2, its points close energizing solenoid valve 225 to open position to allow high pressure air from conduit 206 to flow to mainfold 221 whereby air lifts 19, 20, 21, 22 raise hot upper platen 26 away from the work and lower platform 35, rapidly.

While TD 2 is in its timing cycle, the pressurized air flowing through solenoid valve 99 and adjustable restricted passageway 216, moves hot upper platen 25 away from the work very slowly until pressurized air from solenoid valve 225 enters manifold 225 and air lifts 19, 20, 21, 22 when the additional air pressure aids in moving the hot upper platen 25, upward, rapidly.

Figure 10:
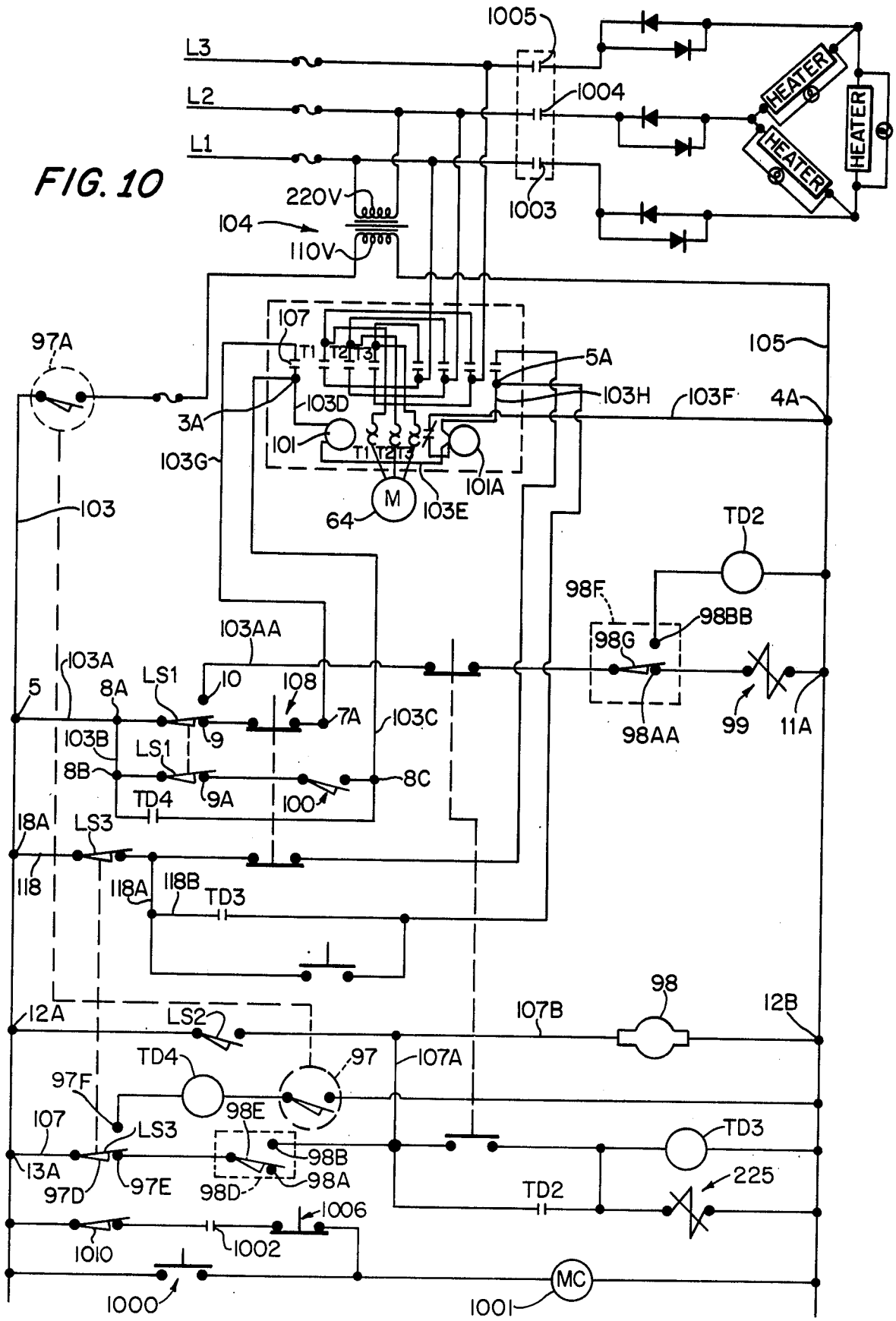
FIG. 10 is a wiring diagram.

The electrical system will now be described with reference to FIG. 10. A 110 volt control circuit is shown with a source of electricity at a transformer 104 and a system starting switch at 100 connected together by conduits 103 and 105.

In operation, an operative closes (foot) switch 100 thereby closing the circuit to motor starter 101 housing a soil which when energized closes contacts T1, T2, T3 and auxiliary holding contact 107 to thereby start motor 64 in a forward rotation.

The circuit is conduit 103 to conduit 103A at terminal 5, and to conduit 103B at terminals 8A, 8B to foot switch 100 and to conduit 103C at terminal 8C, to conduit 103D at terminal 3A, to motor starter 101 forward coil to conduits 103E, 103F to conduit 105 at terminal 4A.

With the closing of holding contact 107, current flows through terminal 7A and across normally closed switch 108 and through normally closed (limit switch) LS #1. Thereby, maintaining current in motor switch 101 to keep motor 64 running.

When motor 64 is running forward, lower platen 35 moves from outboard loading position to inboard position in registry or directly under and aligned with upper hot platen 25.

As lower platen moves inwardly, it strikes double pole limit switch LS #1, thereby actuating the switch by opening the normally closed points 9, 9A and closing normally open points 10. With the opening of LS #1, current to motor starter 101 ceases, thereby opening contacts T1, T2, and T3 and 107 to stop motor 64.

A solenoid valve 99 is connected on one side to conduit 105 at terminal 11A and on the other side to conduit 103AA, when LS #1 is actuated. The solenoid valve 99 coil is energized to shut off the air to the four air lift cylinders 19, 20, 21, 22 (see FIG. 9). The valve seat in shuttle valve 212 moves to valve seat #1 to allow the exhausted air from manifold 221 to pass to shuttle valve 211 and exhaust muffler "M" to the atmosphere.

Simultaneously, with the exhausting of the high pressurized air, the (eight) compression spring mechanisms 326 pull upper platen 25 downwardly so as to cause upper platen 25 to engage lower platen 35.

As upper platen 25 moves downwardly, it engages LS #2 to close the circuit to the adjustable timer 98 provided with conduit 107B is connected on one side to line 103 at terminal 12A and on the other side to line 105 at terminal 12B. The electric timer 98, provided with contact points 98A, 98B and 98AA, 98BB, begins a count of time for the period the upper platen 25 engages lower platen 35. At the conclusion of the time period the timer's contact points 98AA open, and 98BB closes.

Simultaneously, with the energizing of adjustable timer 98, single pole, double throw switch 98 D incorporated in timer 98, and provided with lever 98E moves from normally open contact 98A to closed position contact 98B. Current now flows from terminal 13A to conduits 107, 107A, 107B to maintain current to timer 98, simultaneous with a current flow from terminal 12A to terminal 12B through timer 98.

At the end of the selected period of time, single pole double throw switch 98F, also incorporated in timer 98, has a switch lever 98G which moves from closed position, contact 98AA to open position contact 98BB to thereby de-energize solenoid valve 99, thereby energizing timer delay relay coil TD 2.

Upper platen 25 begins to lift away from lower platen 35, slowly. Timer delay relay Td 2 counts a pre-determined time period and then normally open points on Td 2 close to cause current to flow from conduit 107A across points TD 2 to energize the coil of rapid drive solenoid valve 225 thereby to increase the speed in the upward movement of upper platen 25 away from lower platen 35. Simultaneously, with the energization of the coil in solenoid valve 225, the coil of TD 3 is energized, thereby starting a time delay for a pre-determined period of time for the upper platen 25 to lift to the full upper position of its stroke. Points on TD 3 now close to start the motor 64 in a reverse direction of rotation to withdraw the lower platen 35 from beneath upper platen 25.

The current flow for the points on TD 3 is from terminal 18A and conduits 118, 118A, 118B to terminal 5A on the motor reversing starter. Conduit 103H connects terminal 5A with reversing coil 101A. The current flows through reversing coil 101A through conduit 103F to conduit 105 at terminal 4A.

Simultaneously, with the energization of reversing coil 101A, contact points T1, T2, T3 are reversed; the motor 64 drives the lower platen 35 to outboard loading position. During outward movement, platen 35 strikes LS3 which stops motor 64.

LS3 is a double pole double throw switch. The second set of points on LS3, when LS3 is actuated, breaks the circuit to timer 98, which resets itself with the breaking of the circuit. The cycle is thus completed. It is necessary to manually actuate switch 100 to initiate the next cycle.

However, a three position selector switch 97 has two poles. One pole at 97A is used to shut off the power to the 110 volt control circuit. This is considered position #1 on the selector switch. The other pole at 97 is open. With the swith 97 in "off" position, both poles (97, 97A) are open. Manually positioning the selector switch 97 to "on" position, the 97A pole closes providing 110 volt power to the control circuit. The pole at 97 remains open. Manually turning the selector switch 97 to "automatic" position: closes the pole at 97. The pole at 97A remains closed.

At the end of the cycle with pole 97 closed, LS3 is actuated by lower platen 35, whereby the circuit to TD4 is closed by the movement of switch arm 97D from contact 97E to contact 97F. TD4 begins a predetermined count, after which the open points at TD4 close to initiate forward rotation of motor 64. During the counting cycle, the operative may load the work upon the lower platen 35. In this manner, the machine cycles automatically.

The circuit to the platen heaters is as follows: Start button 1000 is manually depressed closing the circuit to the magnetic contactor 1001. The auxiliary points 1002 on the contactor close and hold current to the coil in the magnetic contactor 1001. Simultaneously, the energization of coil in contactor 1001, contacts points 1003, 1004, 1005 close providing current to the heaters.

Manual operation of stop switch (normally closed) 1006 breaks the holding circuit to the magnetic contactor 1001.

In the event of a switch failure a high level thermostat 1010 located in the top platen breaks the holding circuit at a preselected temperature.

Figure 7:
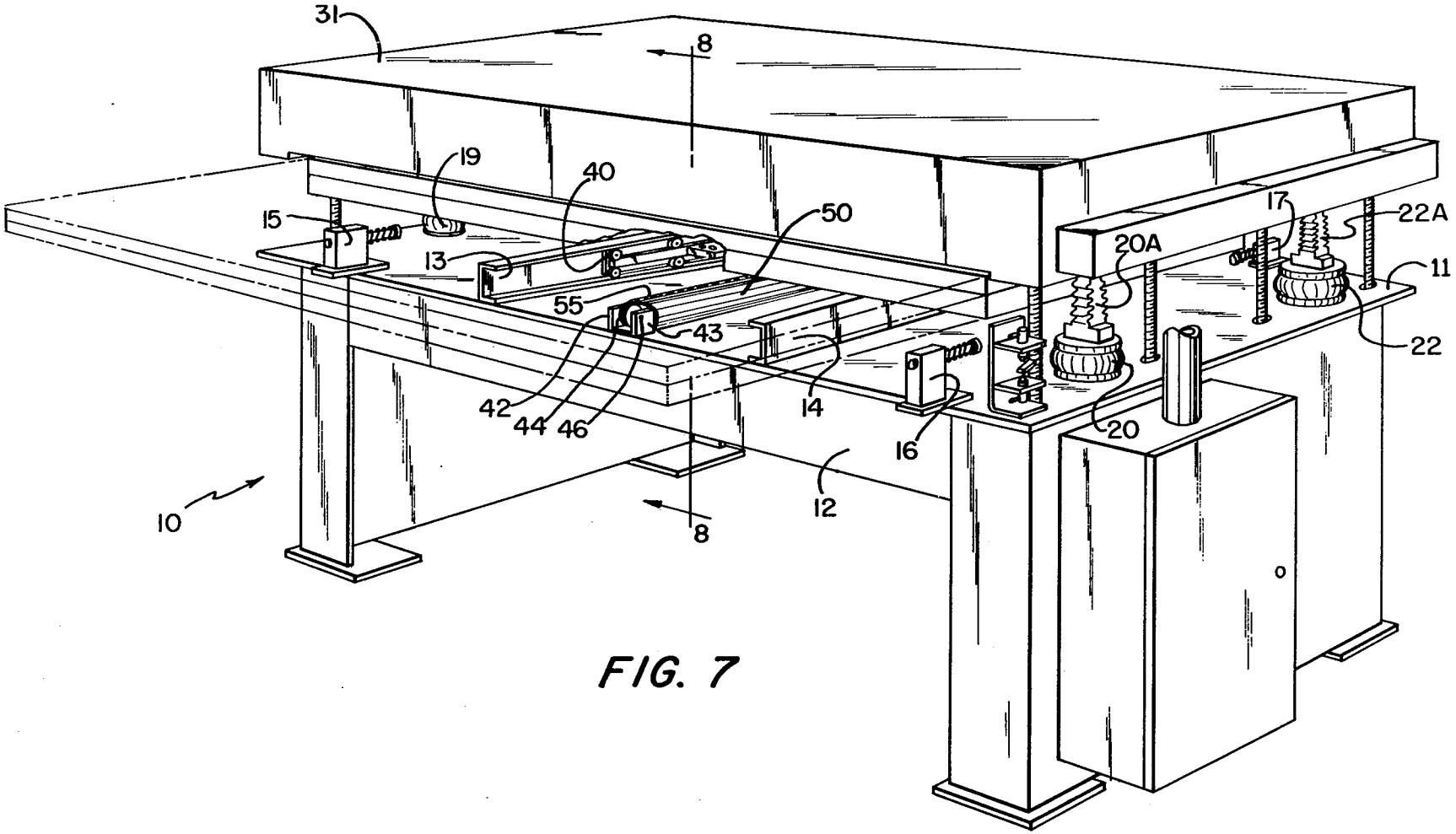
FIG. 7 is a perspective view of a modified form of traversing mechanism.
Figure 8:
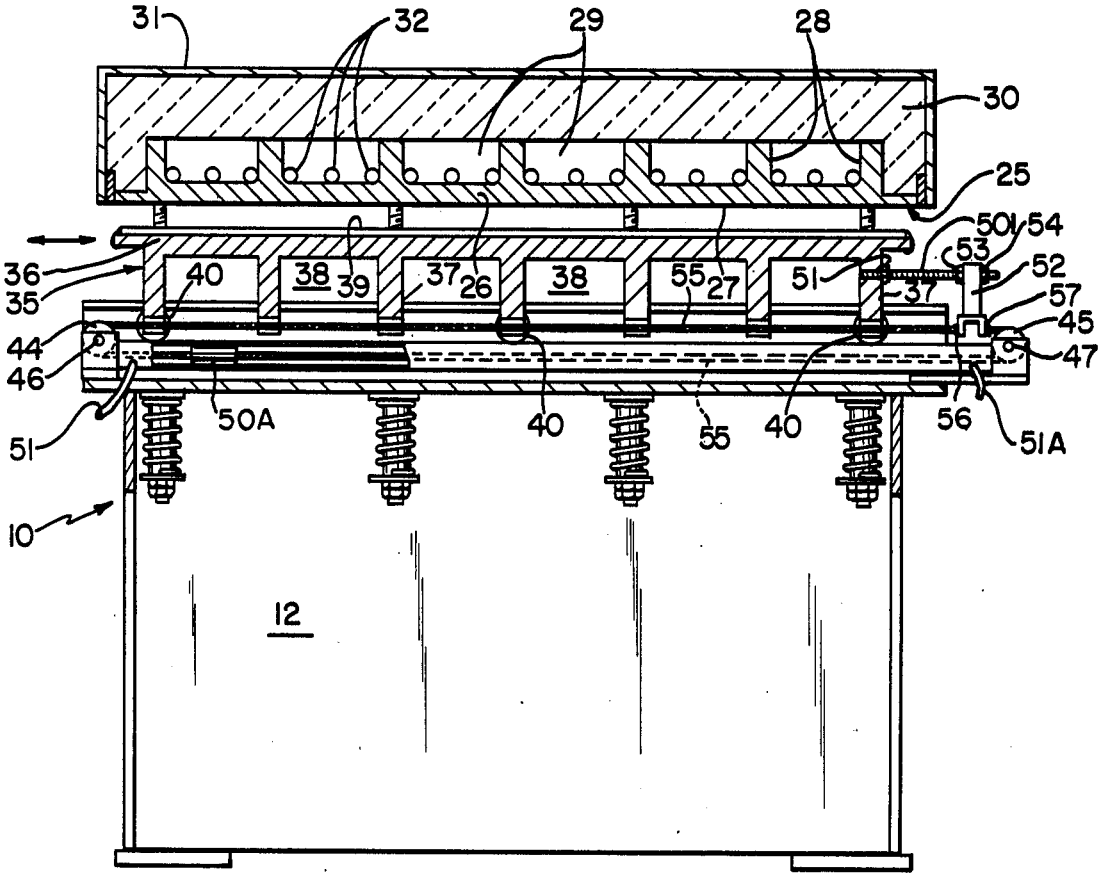
FIG. 8 is a vertical cross-sectional view taken on line 8—8 of FIG. 7.

Attention is directed to FIGS. 7 and 8 wherein is disclosed a modified form of structure to move the lower platen 35 into and out of register with upper platen 25.

A plurality of rollers 40 are rotatably mounted to a rail 537 so as to freely travel and be guided in, respectively, two channels or "U" shaped channels or tracks 13, 14 fastened to top 11. A pulley structure is disclosed in FIG. 8. It comprises two spaced apart plates 42, 43 are fastened to table top 11. Two pulleys 44, 45 are rotatably mounted between plates 42, 43 by means of pintel means or stud shafts 46, 47, respectively, fastened in said plates. A threaded shaft 501 is rotatably fastened to a projection 37 and held in position by nut 51. A bracket 52 is fastened to shaft 501 and held in selected position along shaft 501 by means of nuts 53, 54. A cable 55 is passed around pulleys 44, 45 with the opposite ends fastened to bracket 52 at 56, 57 to form a loop. An air cylinder 50, fastened to top 11, is provided with a slidably mounted piston 50A and two connections 51, 51A attached to a pneumatic system for reciprocating the piston. Cable 55 is fastened to opposite ends of the piston to form a closed loop. Reciprocation of the piston moves the lower platen 35 into and out of register with the upper platen.

Having shown and described preferred embodiments of the present invention by way of example, it should be realized that structural changes could be made and other examples given without departing from either the spirit or scope of this invention.

What I claim is:

1. A heat transfer press, comprising a support, a lower platen on said support, an upper platen on said support, said lower platen having moving means associated with said support and adapted to move said lower platen horizontally towards and away from said support, four expandable resilient material air lift cylinders, each provided with a heat dissipating lug, an air conduit attached to each of said four air lift cylinders to act and react said cylinders in unison, said upper platen having moving means associated with said support comprising an upper platen body provided with a face, said four air lift cylinder heat dissipating lugs attached to said body, said body having a plurality of chambers therebetween, and a plurality of radiant heating tubes fastened, respectively, in said plurality of chambers, said heating tubes heating said face, a plurality of rods, each rod fastened on one end to said body, and each rod provided with a compression spring resistance mechanism on the other end, said spring resistance mechanism resiliently urging said upper platen downwardly towards said lower platen against the resistance of said four air lift cylinders, said lower platen being positioned beneath said upper platen at one end of its movement, timing means for actuating said upper platen moving means only when said lower platen is therebeneath and for actuating said lower platen moving means only when said upper platen is in its uppermost position, whereby said platens are moved from an open position, wherein a work piece can be placed on said lower platen to a second position wherein said lower and upper platens are juxtaposed to press said work piece therebetween and to transfer heat thereto, whereby colored pictures printed on paper are transferred to polyester cloth heat softened to receive the ink vaporized by said heat, said vaporized ink passing into the heat softened fibers of the cloth to dye said cloth permanently upon cooling, said upper platen being moved upwardly by said four air lift cylinders and moved downwardly by said compression springs.

2. A heat transfer press as set forth in claim 1 wherein said lower platen is suported on rolls and is moved by an electric motor.

3. A heat transfer press as set forth in claim 2 wherein said pneumatic means moves said upper platen upwardly through a first incremental distance and thereafter at a higher speed.

* * * * *